US007121851B1

(12) United States Patent
Beatty et al.

(10) Patent No.: US 7,121,851 B1
(45) Date of Patent: Oct. 17, 2006

(54) SYSTEM AND METHOD FOR MULTI-POSITIONAL POWER SUPPLY ADAPTOR

(75) Inventors: Alan R. Beatty, Plantation, FL (US); Sacha B. Holland, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/137,216

(22) Filed: May 25, 2005

(51) Int. Cl.
*H01R 13/44* (2006.01)

(52) U.S. Cl. ..... 439/131; 439/141

(58) Field of Classification Search ..... 439/131, 439/140, 141, 651, 695, 367; 174/59, 65, 174/48; 307/326; 320/111
See application file for complete search history.

(56) References Cited

U.S. PATENT DOCUMENTS 5,073,381 A * 12/1991 Ivan et al. ..... 424/487
5,613,863 A * 3/1997 Klaus et al. ..... 439/131
5,739,596 A 4/1998 Takizawa et al.
6,190,184 B1 * 2/2001 Cimbal et al. ..... 439/131
6,231,358 B1 * 5/2001 Kerr et al. ..... 439/140
6,275,002 B1 * 8/2001 Chen ..... 320/111
6,398,566 B1 * 6/2002 Chen ..... 439/131
6,638,113 B1 * 10/2003 Kajiwara et al. ..... 439/651
6,641,412 B1 * 11/2003 Kitagawa et al. ..... 439/131
6,770,986 B1 * 8/2004 Nagao et al. ..... 307/326
6,793,509 B1 * 9/2004 Chen ..... 439/136
6,840,784 B1 * 1/2005 Chang ..... 439/131
6,851,960 B1 2/2005 Bain et al.
2002/0090848 A1 * 7/2002 Yu ..... 439/131
2004/0201950 A1 * 10/2004 Bothe et al. ..... 361/603

* cited by examiner

*Primary Examiner*—Alexander Gilman

(57) ABSTRACT

A portable (travel) charger or power adaptor (10) can minimize the protrusion from a wall when used as a wall mounted charger and can further maximize the number of power adaptors that can be (safely) plugged into a standard AC strip. The power adaptor can include a housing (12) containing a power transformer and a pair of pivoting prongs (13 and 15) forming a plug (14) arranged to be substantially near a top portion of the housing. The pair of pivoting prongs in a first position or horizontal position can make the adaptor suitable or configured for coupling to an AC wall outlet receptacle and in a second position or vertical position can make the adaptor suitable or configured for placement in an AC strip receptacle (22) of a standard power strip (20).

13 Claims, 2 Drawing Sheets

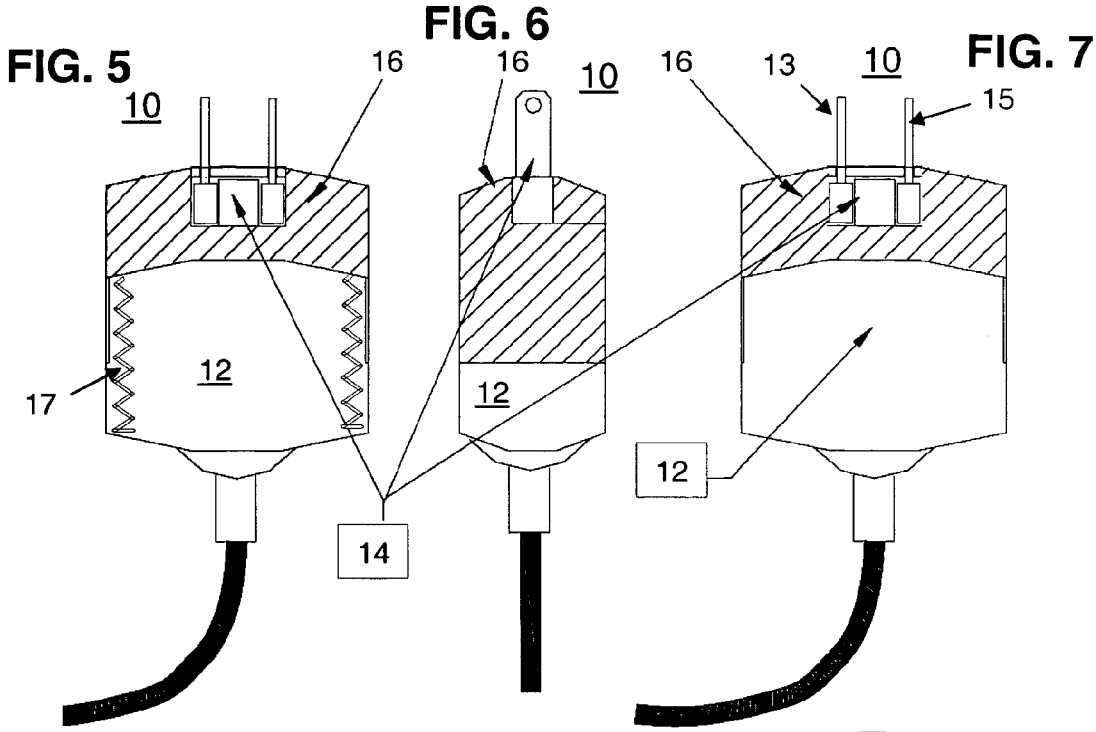
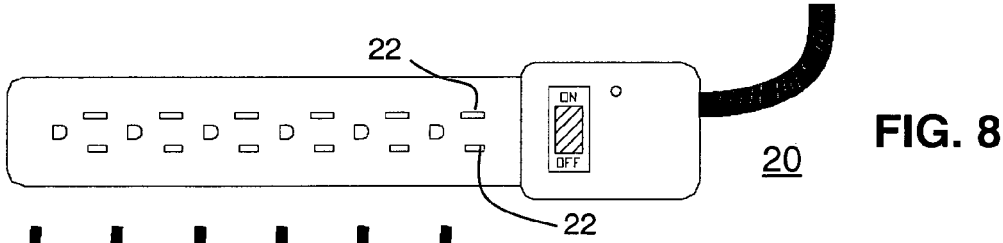
FIG. 8
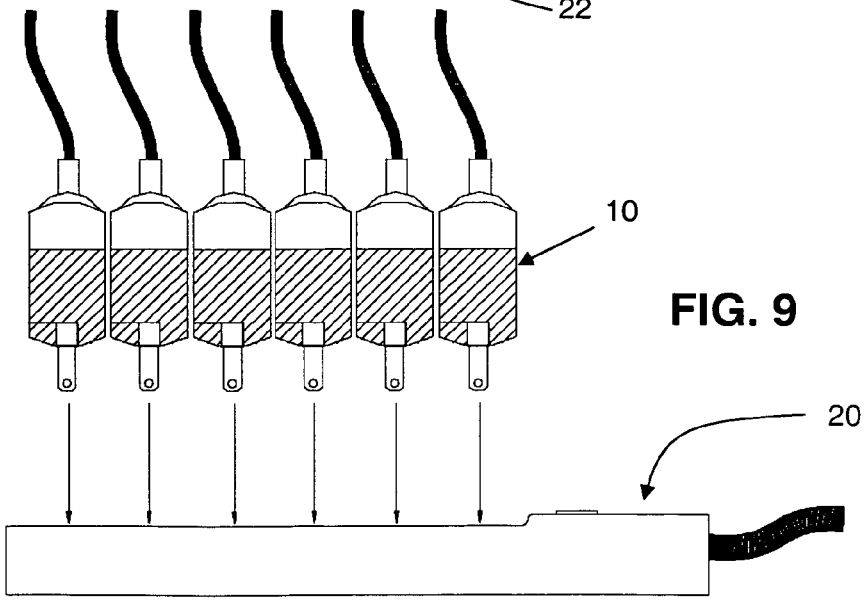
FIG. 9

SYSTEM AND METHOD FOR MULTI-POSITIONAL POWER SUPPLY ADAPTOR

FIELD OF THE INVENTION

This invention relates generally to power supplies, and more particularly to a method and system for enabling a multi-positional power supply to easily couple to both wall outlets and outlet strips.

BACKGROUND OF THE INVENTION

Rechargeable devices such as cellular phones that use a wall mounted power supply to charge the internal batteries of such device are limited to charging only one or two devices at a time when using a standard 6 receptacle AC strip due to the geometry of standard receptacle AC strip. These power supply chargers or alternating current (AC) adaptors are designed for use with a standard wall receptacle to minimize the protrusion from the wall so they do not fall out due to gravity. When used in a AC strip, such existing AC adaptors take up too much space to allow more than two power supplies at a time or at least do not allow two such AC adaptors to be adjacent to each other. Some manufactures offer a vertically mounted supply that is specifically designed and fixed to allow mounting into a 6 receptacle AC strip. This device would then protrude too far from a wall to be practical for a wall mounted charger. The protruding adaptor in such instance would typically fall out of the wall mounted receptacle and likely cause obstacles for furniture placement or hazards for walkers passing by the protruding adaptor.

SUMMARY OF THE INVENTION

Embodiments in accordance with the present invention can provide a multiple use wall mounted charger with an optional movable protective cover. Such charger or AC adaptor can enable the ergonomic placement of multiple adaptors on AC outlet strips as well as on wall mounted receptacles.

In a first embodiment of the present invention, a power supply adaptor such as an alternating current (AC) adaptor can include a housing containing a power transformer and a pair of pivoting prongs arranged to be substantially near a top portion of the housing. The pair of pivoting prongs in a first position can make the power supply adaptor suitable or configured for coupling to an alternating current wall outlet receptacle and in a second position substantially perpendicular to the first position can make the power supply adaptor suitable or configured for placement in an alternating current strip receptacle. The power supply adaptor can further include a moveable cover coupled to the housing that covers the pair of pivoting prongs in the second position when the moveable cover is in an extended position. An internal spring mechanism coupled to the moveable cover can be used to bias the moveable cover in the extended position. The pair of pivoting prongs in the second position become exposed when the moveable cover is placed in a compressed position. Note, the pair of pivoting prongs in the first position protrude outside the moveable cover. Further note, the process of placing the pair of pivoting prongs when in the second position into an AC outlet receptacle causes the moveable cover to move into a compressed position and a removal from the AC outlet receptacle causes the moveable cover to return to the extended position.

In a second embodiment of the present invention, a multi-positional power supply adaptor can include a housing containing a power transformer and a pair of prongs arranged to be substantially near a top portion of the housing. The pair of prongs in a vertical position makes the power supply adaptor suitable or configured for coupling to an AC wall outlet receptacle and the pair of prongs in a position substantially perpendicular to the vertical position (or horizontal position) makes the power supply adaptor suitable or configured for placement in an AC strip receptacle.

In a third embodiment of the present invention, a method of selectively altering a power adaptor for use in conjunction with at least one among an alternating current wall outlet receptacle and an alternating current strip outlet receptacle can include the steps of selectively placing a pair of pivoting prongs in a first position suitable or configured for coupling to the alternating current wall outlet receptacle and selectively placing a pair of pivoting prongs in a second position substantially perpendicular to the first position suitable or configured for placement in an alternating current strip receptacle. The method can further include the step of covering the pair of pivoting prongs when in the second position with a moveable cover when the moveable cover is in an extended position and exposing the pair of pivoting prongs in the second position when the moveable cover is placed in a compressed position. The pair of pivoting prongs can also be exposed when in the first position when the moveable cover is placed in an extended position. Note, the process of placing the pair of pivoting prongs when in the second position into an alternating current outlet receptacle causes the moveable cover to move into a compressed position and a removal from the alternating current outlet receptacle causes the moveable cover to return to the extended position.

BRIEF DESCRIPTION OF THE DRAWINGS

FIG. 5 is a top view illustration of the power adaptor of FIG. 1 with a cover in a compressed position in accordance with an embodiment of the present invention FIG. 6 is a side view illustration of the power adaptor of FIG. 5.

FIG. 7 is a bottom view illustration of the power adaptor of FIG. 5.

FIG. 8 is an illustration of a standard AC strip having 6 outlets.

FIG. 9 is an illustration of how multiple power adaptors in accordance with an embodiment of the present invention fit on the standard AC adaptor.

DETAILED DESCRIPTION OF THE DRAWINGS

Figure 1:
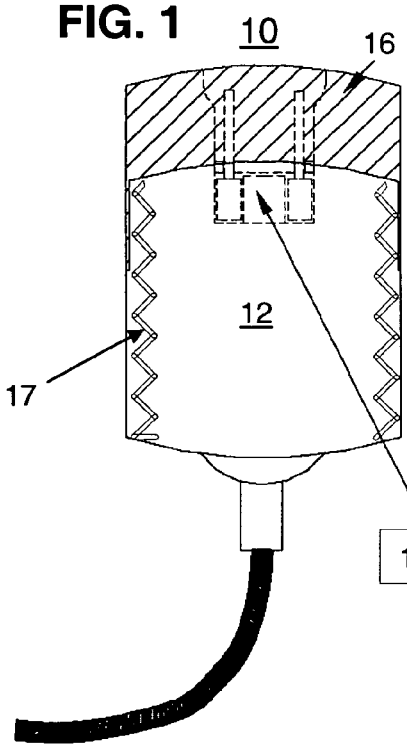
FIG. 1 is a top view illustration of a power adaptor having pivoting prongs in a stored or vertical or second position in accordance with an embodiment of the present invention.

While the specification concludes with claims defining the features of embodiments of the invention that are regarded as novel, it is believed that the invention will be better understood from a consideration of the following description in conjunction with the figures, in which like reference numerals are carried forward.

Figure 2:
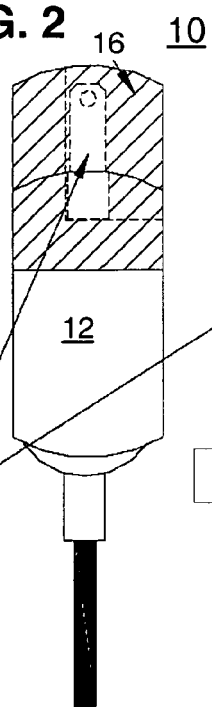
FIG. 2 is a side view illustration of the power adaptor of FIG. 1.
Figure 3:
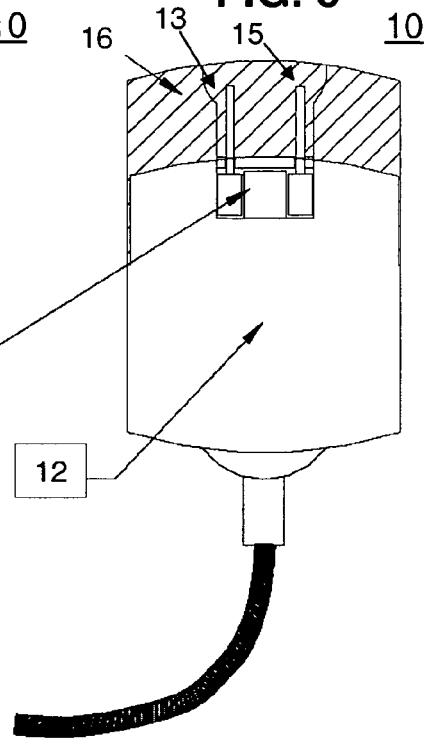
FIG. 3 is a bottom view illustration of the power adaptor of FIG. 1.
Figure 4:
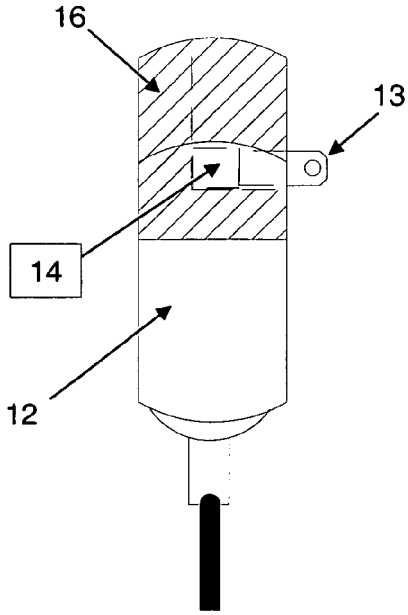
FIG. 4 is side view illustration of the power adaptor of FIG. 1 with the pivoting prongs in a horizontal or first position in accordance with an embodiment of the present invention.

Referring to FIGS. 1–7, a portable (travel) charger or power adaptor 10 such as an AC adaptor is shown that can minimize the protrusion from a wall when used as a wall mounted charger and that can further maximize the number of power adaptors that can be (safely) plugged into a standard AC strip. The power adaptor 10 can include a housing 12 containing a power transformer and a pair of pivoting prongs 13 and 15 forming a plug 14 arranged to be substantially near a top portion of the housing. The pair of pivoting prongs in a first position or horizontal position as shown in FIG. 4 can make the power supply adaptor suitable or configured for coupling to an alternating current wall outlet receptacle and in a second position or vertical position (as shown in FIGS. 5–7) substantially perpendicular to the first position can make the power supply adaptor 10 suitable or configured for placement in an alternating current strip receptacle 22 of a standard power strip 20 as shown in FIG. 8. While the adaptor 10 is in the first position as shown in FIG. 4, this configuration allows the charger to be used as a standard wall mounted device with minimal protrusion from the wall. In this manner, it does not cause an obstacle and is inclined to remain within the AC wall receptacle.

The power supply adaptor 10 can further include a moveable cover 16 (shown with cross-hatching) coupled to the housing that covers the pair of pivoting prongs in the second position when the moveable cover is in an extended position. An internal spring mechanism 17 coupled to the moveable cover can be used to bias the moveable cover in the extended position. The pair of pivoting prongs in the second position become exposed when the moveable cover is placed in a compressed position. Note, the pair of pivoting prongs in the first position protrude outside the moveable cover 16 and housing 12. Further note, the process of placing the pair of pivoting prongs when in the second position into an AC outlet receptacle causes the moveable cover to move into a compressed position as shown in FIGS. 5–7 and a removal from the AC outlet receptacle causes the moveable cover to return to the extended position as shown in FIGS. 1–3. When using a cover 16 as shown in FIGS. 1–3, the adaptor 10 is considered to be in a "store" position. The movable protective cover 16 covers the prongs 13 and 15 or AC blades when the cover is in a storage position or extended position and protects the prongs when not in use. A hole or opening in the cover 16 as shown in FIG. 3 enables a user to pull down or push up the prongs into the first (horizontal) or second (vertical) position as needed.

With the prongs or AC blades 13 and 15 in the "storage" or vertical position, a maximum number of adaptors 10 can be plugged vertically into an AC strip as shown in FIG. 9. If the prongs were oriented in a horizontal fashion, the geometry of the housing for such adaptors 10 would not permit the maximum number of adaptors to be plugged into the strip outlet 20. Thus, the adaptor 10 in a vertical orientation with the prongs in a stored position and pointing towards the respective AC receptacles of the strip outlet can efficiently place and plug a maximum number of plugs into the strip outlet. When the adaptor 10 is pressed towards the strip 20, the protective cover 16 will slide back revealing the AC blades or prongs 13 and 15. The pressure is continued until the blades are inserted all the way into the AC receptacle 22. Again, this arrangement will allow the insertion of as many chargers as the strip outlet 20 can hold. When the adaptor 10 is removed from the receptacle 22, the internal spring mechanism 17 will return the protective cover 16 to its original position.

In light of the foregoing description, it should also be recognized that embodiments in accordance with the present invention can be realized in numerous configurations contemplated to be within the scope and spirit of the claims. Additionally, the description above is intended by way of example only and is not intended to limit the present invention in any way, except as set forth in the following claims.

What is claimed is:

1. A power supply adaptor, comprising:

a housing containing a power transformer;

a pair of pivoting prongs arranged to be substantially near a top portion of the housing;

wherein the pair of pivoting prongs in a first position makes the power supply adaptor configured for coupling to an alternating current wall outlet receptacle and the pair of pivoting prongs in a second position substantially perpendicular to the first position makes the power supply adaptor configured for placement in an alternating current strip receptacle;

wherein the power supply adaptor further comprises a moveable cover coupled to the housing that covers the pair of pivoting prongs in the second position when the moveable cover is in an extended position and the pair of pivoting prongs in the second position become exposed when the moveable cover is placed in a compressed position.

2. The power supply adaptor of claim 1, wherein the pair of pivoting prongs in the first position protrude outside the moveable cover.

3. The power supply adaptor of claim 1, wherein the power supply further comprises an internal spring mechanism coupled to the moveable cover that biases the moveable cover in the extended position.

4. The power supply adaptor of claim 1, wherein the power supply adaptor is an alternating current adaptor.

5. The power supply of claim 1, wherein the process of placing the pair of pivoting prongs when in the second position into an alternating current strip receptacle causes the moveable cover to move into a compressed position and a removal from the alternating current strip receptacle causes the moveable cover to return to the extended position.

6. A multi-positional power supply adaptor, comprising:

a housing containing a power transformer;

a pair of prongs arranged to be substantially near a top portion of the housing;

wherein the pair of prongs in a horizontal position makes the power supply adaptor configured for coupling to an alternating current wall outlet receptacle and the pair of prongs in a vertical position makes the power supply adaptor configured for placement in an alternating current strip receptacle;

wherein the power supply adaptor further comprises a moveable cover coupled to the housing that covers the pair of pivoting prongs in the vertical position when the moveable cover is in an extended position and the pair of pivoting prongs in the vertical position become exposed when the moveable cover is place in a compressed position.

7. The power supply adaptor of claim 6, wherein the pair of pivoting prongs in the horizontal position protrude outside the moveable cover.

8. The power supply adaptor of claim 6, wherein the power supply further comprises an internal spring mechanism coupled to the moveable cover that biases the moveable cover in the extended position.

9. The power supply adaptor of claim 6, wherein the power supply adaptor is an alternating current adaptor.

10. The power supply of claim 6, wherein the process of placing the pair of pivoting prongs when in the vertical position into an alternating current strip receptacle causes the moveable cover to move into a compressed position and a removal from the alternating current strip receptacle causes the moveable cover to return to the extended position.

11. A method of selectively altering a power adaptor for use in conjunction with at least one among an alternating current wall outlet receptacle and an alternating current strip outlet receptacle, comprising the steps of:

selectively placing a pair of pivoting prongs in a first position configured for coupling to the alternating current wall outlet receptacle;

selectively placing a pair of pivoting prongs in a second position substantially perpendicular to the first position configured for placement in an alternating current strip receptacle;

covering the pair of pivoting prongs when in the second position with a moveable cover when the moveable cover is in an extended position; and exposing the pair of pivoting prongs in the second position when the moveable cover is placed in a compressed position.

12. The method of claim 11, wherein the method further comprises the step of exposing the pair of pivoting prongs when in the first position when the moveable cover is placed in an extended position.

13. The method of claim 11, wherein the process of placing the pair of pivoting prongs when in the second position into an alternating current strip receptacle causes the moveable cover to move into a compressed position and a removal from the alternating current strip receptacle causes the moveable cover to return to the extended position.

* * * * *